United States Patent [19]

Greenwood

[11] 4,380,308

[45] Apr. 19, 1983

[54] SELF-CLEANING ADHESIVE DISPENSING APPARATUS

[76] Inventor: David L. Greenwood, 3118 Sandy La., Glenview, Ill. 60025

[21] Appl. No.: 220,247

[22] Filed: Dec. 23, 1980

[51] Int. Cl.[3] ..... B67D 1/08

[52] U.S. Cl. ..... 222/148; 222/399; 222/529; 239/113; 134/102; 137/240

[58] Field of Search ..... 222/1, 148, 399, 400.7, 222/527, 529; 134/102, 166 C, 169 C, 167 C; 137/239, 240; 239/112, 113

[56] References Cited

U.S. PATENT DOCUMENTS

| | | | |
|---|---|---|---|
| 2,016,926 | 10/1935 | Josepowitz | 134/102 |
| 2,023,854 | 12/1935 | Petricone | 222/148 |
| 2,189,950 | 2/1940 | Gump | 222/148 |
| 3,371,822 | 3/1968 | Galloway | 222/400.7 |
| 3,424,349 | 1/1969 | Vance | 222/148 |
| 4,033,481 | 7/1977 | Hicks et al. | 222/148 |

*Primary Examiner*—H. Grant Skaggs
*Attorney, Agent, or Firm*—Dressler, Goldsmith, Shore, Sutker & Milnamow, Ltd.

[57] ABSTRACT

An apparatus and method are disclosed for dispensing adhesive materials, with the apparatus being self-cleaning for changeover of the adhesive supply.

Adhesive is provided in a sealed container, which can be subjected to pressure. As the container is subjected to increased pressure, some of the adhesive travels upwardly through a dip tube and exits through an opening in the lid in the container. The dip tube communicates with a flexible conduit which leads to a dispenser for the adhesive. The adhesive travels through the dip tube, flexible conduit and dispenser in a first, outward direction when the adhesive is being dispensed.

To purge the dip tube, flexible conduit and dispenser of adhesive, the open end of the dispenser is operably connected to a source of compressed air, and the air enters the dispenser, and travels through the flexible conduit and the dip tube until it enters the container. Thus, the air travels through the flexible conduit in a second, opposite, inward direction for flushing the adhesive material out of the dispenser, flexible conduit and the dip tube and back into the container.

5 Claims, 2 Drawing Figures

SELF-CLEANING ADHESIVE DISPENSING APPARATUS

FIELD OF THE INVENTION

The present invention relates to a method and apparatus for dispensing adhesive material from an apparatus and for cleaning the adhesive from the apparatus when it is desired to refill or replace the supply of adhesive.

BACKGROUND OF THE INVENTION

Pressure-actuated devices are known for dispensing adhesives or sealants in controlled quantities through a hand held dispenser, or wand, connected by flexible tubing to a sealed container, or pressure pot. Some of the most frequently used adhesives and sealants are cyanoacrylates, anaerobics, water white glues, solvents and solder mask compounds.

The prior art devices typically include the aforementioned sealed container, or pressure pot, in which the adhesive is provided. The container is subjected to increased air pressure, which causes some of the adhesive to travel upwardly through a dip tube in the container and exit the container through an opening in the lid. The dip tube communicates with a flexible conduit that leads to the aforementioned dispenser, or wand, for the adhesive.

Whenever it is desired to refill or replace the adhesive in the container, some of the adhesive remains in the tube, the flexible conduit and the dispenser.

Problems arise with the prior art devices when it is necessary to refill or replace the supply of adhesive. During the changeover process, adhesive can leak out through both the dip tube and the dispenser, and there is sometimes a whipping action from the relatively long flexible conduit that causes the splattering of adhesive onto the operator, the apparatus, and the surrounding environs. Such leakage is particularly harmful when the adhesive is a cyanoacrylate which can cause dangerous adhesion to the skin surface of the operator. Still another disadvantage is that the dripping adhesive material is wasted.

SUMMARY OF THE INVENTION

The foregoing disadvantages of the prior art are overcome in accordance with the present invention in which an apparatus is provided for dispensing adhesive materials, with the apparatus being self-cleaning for changeover of the adhesive supply.

Adhesive is provided in a sealed container, which can be subjected to pressure. As the container is subjected to increased pressure, some of the adhesive travels upwardly through a dip tube and exits through an opening in the lid in the container. The tube communicates with a fluid conduit which leads to a dispenser for the adhesive. The adhesive travels through the tube, conduit and dispenser in a first, outward direction when the adhesive is being dispensed.

To purge the dip tube, conduit and dispenser of adhesive, the open end of the dispenser is operably connected at the time of adhesive supply changeover to a source of compressed air, and the air enters the dispenser, and travels backwardly through the flexible conduit and the dip tube until it reenters the container. Thus, the air travels through the conduit in a second, opposite, inward direction for flushing the adhesive material out of the dispenser, flexible conduit and dip tube and back into the container.

More specifically, a self-cleaning apparatus for dispensing adhesive materials from a container of adhesive, in accordance with the present invention, includes means for providing compressed air under pressure. First and second air lines each have one end secured to the compressed air means.

Pressure regulator means communicates with the opposite end of the first air line. A normally closed solenoid valve means communicates with the opposite end of the second air line.

The container has a lid that defines first and second openings, and dip tube means extends downwardly from the second opening. A third air line has one end in communication with the pressure regulator means, and an opposite end secured to the first opening in the lid for providing pressurized air to the container. A flexible conduit has one end secured to the second opening in the lid for receiving adhesive from the container.

Means is provided at the opposite end of the flexible conduit for dispensing the adhesive; and the adhesive dispensing means has an open end. Pneumatically operated first valve means is operatively connected to the exterior of the flexible conduit for opening and closing the conduit. A fourth air line extends between and communicates with the solenoid valve means and the first valve means.

Means is provided for actuating the solenoid valve means for providing pressurized air to travel through the solenoid and the fourth air line to the first valve means. A fifth air line has one end communicating with the second air line between the compressed air means and the solenoid valve means.

Nozzle means is secured to the opposite end of the fifth air line, and the nozzle means is adapted to make an air-tight connection with the open end of the dispensing means. Second valve means is operatively connected to the fifth air line for opening and closing the fifth air line.

In order to dispense adhesive, the pressure regulator means is set at a predetermined value, compressed air travels from the means for providing compressed air, through the first air line, the pressure regulator means, and the third air line into the container. The adhesive thereby travels from the container through the dip tube means and into the flexible conduit, whereupon the adhesive can be dispensed by operating the means for actuating the solenoid valve means, usually by a foot switch, or by a switch located on the hand held dispenser, or wand. The compressed air also travels from the means for providing compressed air, through the second air line, the solenoid and the fourth air line to the first valve means to open the first valve means, whereupon the adhesive travels through the flexible conduit and through the dispensing means.

To purge the adhesive from the dispensing means, conduit and the dip tube means at changeover time, the pressure regulator means is closed or set at zero pressure, and the first and second valves are opened to relieve the pressure in the container. The nozzle means on the fifth air line is then connected to the open end of the wand, permitting the compressed air to travel from the means for providing compressed air, through the second air line, the fifth air line, the nozzle means, the dispensing means, the flexible conduit, the dip tube means, and into the container, thereby flushing the adhesive into the container from the dispensing means, conduit and the tube means. The container lid is then removed, the container refilled or replaced, and the lid then resealed to the full container. During this changeover, the flexible conduit and dip tube means are empty and do not drip adhesive.

A method of dispensing adhesive from an apparatus and for cleaning the adhesive from the apparatus, in accordance with the present invention, comprises the steps of providing a supply of adhesive in a sealed container and a supply of compressed air, moving a controlled quantity of the compressed air to the container through first air line means, increasing the pressure on the adhesive in the sealed container by means of the compressed air, forcing a controlled quantity of adhesive out of the container by means of the pressure and into flexible conduit means, and directing the controlled quantity of adhesive from the flexible conduit means to dispensing means having an open end for dispensing the adhesive.

The method includes the further steps of cleaning the dispensing means by providing means for stopping the flow of adhesive through the flexible conduit means, providing a controlled quantity of the compressed air into second air line means, and connecting the second air line means to the open end of the dispensing means for directing the air from the second air line means into the open end of the dispensing means, thereby forcing the adhesive by means of the air back through the dispensing means and the conduit means and back into the container.

DESCRIPTION OF THE PREFERRED EMBODIMENT

Figure 1:
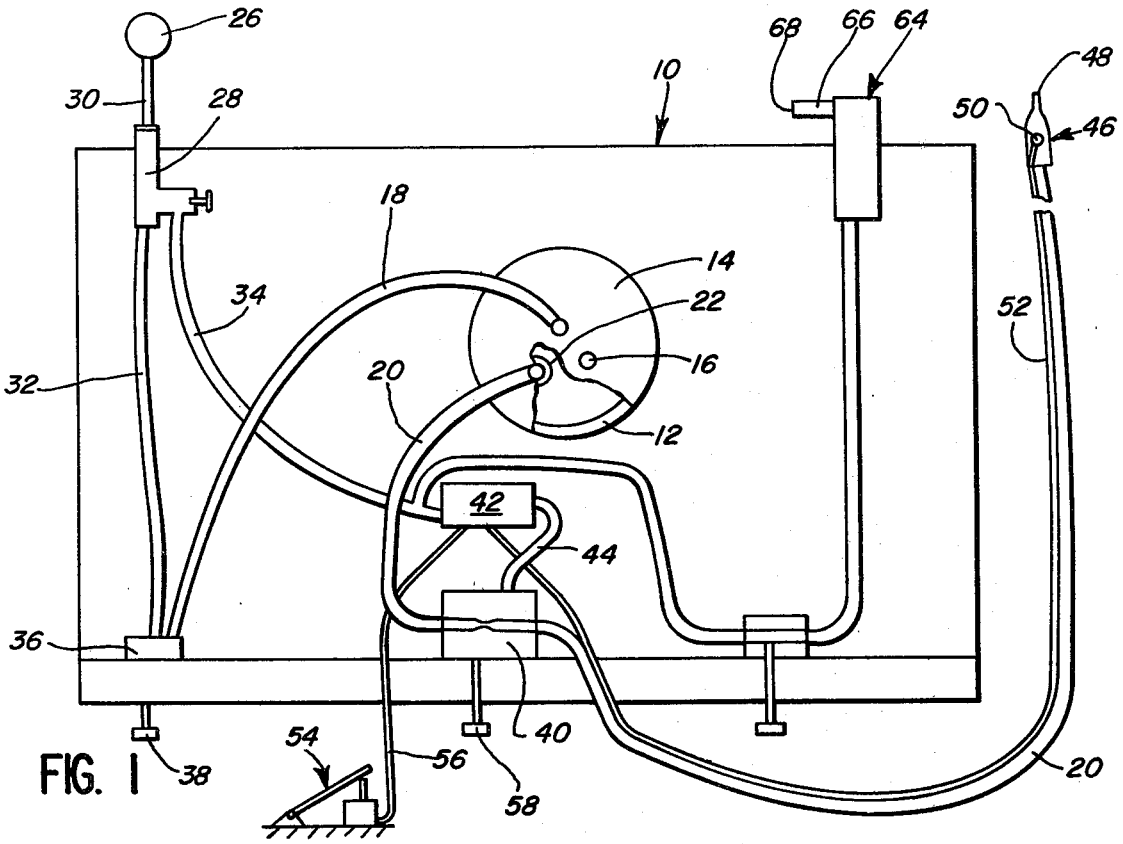
FIG. 1 is a schematic illustrating a self-cleaning apparatus for dispensing adhesive materials in accordance with the present invention in the condition for dispensing the adhesive material.

While this invention is susceptible of embodiment in many different forms, there is shown in the drawing and will herein be described in detail one embodiment of the invention, with the understanding that the present disclosure is to be considered as an exemplification of the principles of this invention and is not intended to limit the invention to the embodiment illustrated.

Figure 2:
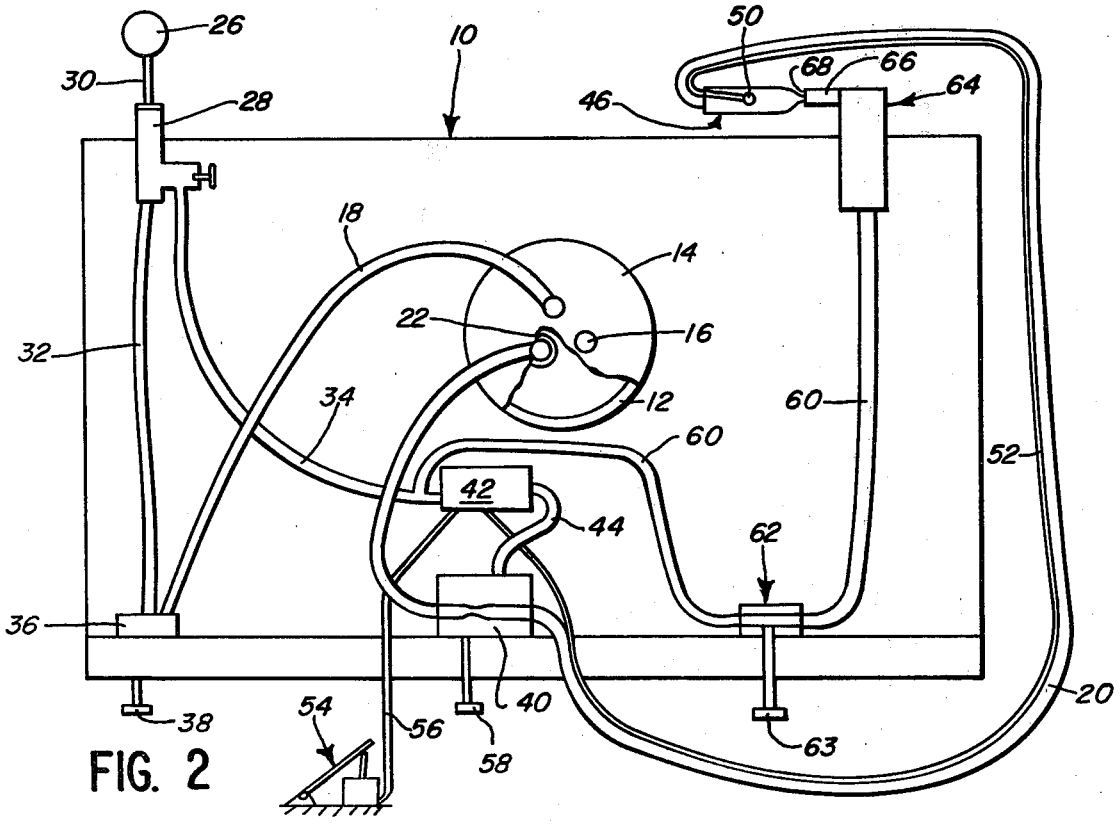
FIG. 2 is a schematic similar to FIG. 1 showing the apparatus in the self-cleaning position.

Referring to the drawing, a self-cleaning apparatus is shown for dispensing adhesive materials from a container of adhesive. FIG. 1 illustrates the apparatus in a condition for dispensing the adhesive material. FIG. 2 shows the apparatus in the position wherein the adhesive is automatically cleaned from the system.

More specifically, referring to FIG. 1, the apparatus 10 includes a sealed container or pressure pot 12 that is filled with a predetermined quantity of an adhesive or sealant, such as cyanoacrylates, anaerobics, water white glues, solvents and solder mask compounds. The container has a screw-on lid 14 that is provided with three openings. A pressure relief valve 16 is secured to one of the openings, air line 18 has one end secured to a second of the openings, and flexible conduit 20 has one end secured to the third opening. A dip tube 22 extends downwardly from the third opening in the lid to within a short distance of the bottom wall of the container 12. The dip tube 22 transmits adhesive from the container into the flexible conduit 20, as will be described in more detail below.

Pressurized air is received in the container 12 between the top surface of the fluid adhesive and the lid 14 of the container. The pressurized air exerts a downward force on the adhesive, which causes it to travel upwardly through the dip tube 22 and into the flexible conduit 20.

The pressurized air is provided by a source of compressed air, such as compressed air cylinder 26. Compressed air from the cylinder 26 travels through the on-off valve 28 through air line 30.

Air lines 32 and 34 each have one end secured to the valve 28. The opposite end of air line 32 communicates with pressure regulator valve 36, which includes a knob 38 that can be manually operated to set the air pressure at a predetermined value, or to a zero position to close the valve so air will not flow through it. The opposite end of air line 18 also communicates with and is secured to the pressure regulator valve 36.

Thus, when the valves 30 and 36 are open, and the pressure relief valve 16 is closed, compressed air flows into the container 12 via conduit 18 that communicates with the opening in the lid with which the conduit 18 communicates, thereby subjecting the adhesive to a downward pressure, and forcing some of the adhesive upwardly through the dip tube 22 and into the flexible conduit 20.

The flexible conduit 20 extends through a pneumatically operated pinch valve 40 that is operatively connected to the exterior of the conduit. The pinch valve 40 either blocks the flexible conduit 20, or permits the flow to continue through the conduit. The pinch valve is normally in the closed position, which blocks the flow through the flexible conduit 20.

The pinch valve 40 can be opened as follows. Pressurized air flows through air line 34 to a solenoid valve 42. Since the air line 34 does not flow through the pressure regulator 36, the air is under a relatively high pressure as compared to the pressure of the air in air lines 32 and 18. Solenoid valve 42 is normally in the closed position. When the solenoid valve is in the open position, air from air line 34 flows through the solenoid 42 and through air line 44 which has opposite ends communicating with the solenoid 42 and the pinch valve 40. The pressurized air is received in a chamber (not shown) in the pinch valve 40. When the air in the chamber reaches a predetermined pressure, the pinch valve 40 is opened, thereby permitting adhesive to flow through conduit 20 past the pinch valve.

The opposite end of the flexible conduit 20 is secured to a dispenser or wand 46 which is held by a user and has an open end 48 for dispensing the adhesive onto a desired object.

In order to dispense the glue from wand 46, the pinch valve 40 must be opened so that adhesive from the container 12 can pass through the flexible conduit 20 all of the way to the wand. This can be accomplished in a number of different ways. First, there is provided a manually depressable button 50 on the wand. The button can be depressed by a finger of the operator. When the button 50 is depressed, it completes an electric circuit, and an electric signal is sent via electric wire 52 from the wand 46 to the solenoid 42, which opens the solenoid. This permits compressed air to pass through the solenoid into the chamber in the pinch valve 40, for opening the pinch valve.

A foot pedal 54 provides an alternate method of opening the pinch valve. By depressing the foot pedal, an operator completes an electric circuit, and an electric signal is sent to the solenoid by way of electric wire 56. The electric signal opens the solenoid valve 42, which enables air to flow into the pinch valve and open it.

A third way to open the pinch valve is by use of a manual knob 58 that is connected directly to the pinch valve.

In operation, glue is dispensed in the following manner. Valve 28 is opened to make available air from the cylinder tank 26, and the pressure regulator valve 38 is turned to a predetermined setting. Air from the cylinder 26 travels through air line 32, through the pressure regulator valve 36, and through air line 18 into the top of the container 12. The pressure in the container increases until adhesive is forced upwardly through dip tube 22 into the conduit 20.

When the operator desires to dispense glue from the wand 46, he can either depress the button 50 in the wand or push down on the foot pedal 54, thereby to activate and open the solenoid valve 42 which, in turn, permits compressed air to travel through air lines 34 and 44 to the pinch valve 40 in order to open the pinch valve. When the pinch valve is opened, the adhesive in the conduit 20 can flow past the pinch valve to the wand 46 and be dispensed through the opening 48 in the wand.

The operator can stop the dispensation of adhesive by releasing the button 50 or foot pedal 54, thereby to open the electric circuit and close the solenoid valve 42, which results in the pinch valve 40 being closed also. When the pinch valve 40 is closed, adhesive in the flexible conduit 20 can no longer flow past the pinch valve to the wand 46, and the adhesive can no longer be dispensed. However, some adhesive remains in the flexible conduit 20 between the pinch valve 40 and the wand 46. Adhesive also remains in the flexible conduit 20 between the container 12 and the pinch valve 40, as well as in the dip tube 22. Atmospheric pressure prevents most of the adhesive from exiting either end of the flexible conduit 20 when any portion of the flexible conduit 20 is closed, as by the pinch valve 40.

It is frequently necessary to replace the container 12 or pot of adhesive, such as when all of the adhesive has been used, or it is desired to substitute a different adhesive. In order to refill or replace the container 12, an operator turns the knob 38 until the pressure regulator valve is at the zero, or closed position, which prevents air from entering air line 18. The pressure relief valve 16 is opened to remove the excess air pressure from the container 12. It is then desirable to disconnect the air line 18 from the lid 14 of the container 12. The lid 14 is then turned to unscrew it from the container 12, to permit removal or partial removal of the lid from the container thereby providing access to the container. The container may then be refilled, or replaced by a filled container.

In accordance with the present invention, means is provided to prevent adhesive from leaking out of the tube 22, the conduit 20, or the wand 46, at changeover time when the adhesive material in the container 12 is being refilled or replaced. This is accomplished by reversing the flow through the conduit 20 to return the adhesive into the container by using air from the cylinder tank 26.

Referring to FIG. 2, a junction or T-shaped connection is provided in air line 34 between valve 28 and solenoid 42. The junction enables air line 60 to communicate directly with air line 34. Air line 60 passes through a purge valve 62 that is normally in the closed position. Thus, when glue is being dispensed from the wand 46, air does not enter and pass through the air line 60.

Air line 60 has one end in communication with air line 34 at the junction of the air lines 34 and 60. The opposite end of air line 60 communicates with and is secured to a nozzle 64 that has a mouth 66. The mouth of the nozzle has an opening 68 at one end that is adapted to receive the open end of the wand 46. The inside diameter of the open end of the nozzle is approximately equal to the outside diameter of the open end of the wand 46, so that an interference fit can be had therebetween.

With the present invention, the adhesive material can be purged from the dip tube 22, the flexible conduit 20 and the wand 46 when the adhesive in the container 12 is going to be refilled or replaced. This is accomplished by turning the knob 38 until the pressure regulator valve is closed, and opening the pressure relief valve 16. The open end of the wand 46 is positioned in the mouth 66 of the nozzle 64, as shown in FIG. 2. The purge valve 62 is opened, as by using knob 63. When valve 62 is opened, air from the cylinder 26 travels through air line 34 and air line 60 to and through the nozzle 64. The operator then opens the pinch valve 40, preferably by either depressing the button 50 or the foot pedal 54.

When both the purge valve 62 and the pinch valve 40 are open, air from the cylinder 26 travels through air line 34 to air line 60, through the purge valve 62 and to the nozzle 64, where the air then passes into the wand 46 through the opening 48. The air continues through the wand and into the flexible conduit 20, where the air carries the adhesive in the wand 46 and the flexible conduit 20 in the reverse direction as compared to the direction of the movement of the adhesive when the adhesive is being dispensed. Air from the flexible conduit 20 travels through the dip tube 22 and into the container 12. The air can then escape through the pressure relief valve 16, which has previously been opened.

In this manner, the air flushes the adhesive material backwards through the system until it is deposited in the container, thereby purging the wand 46, flexible conduit 20 and dip tube 22 of the adhesive material. As a result, the problem of adhesive dripping out of the wand 46, conduit 20 and the dip tube 22 is minimized, or eliminated, when there is changeover of the adhesive supply.

The operator then completes the refilling or replacement of adhesive by disconnecting the air line 18 from the lid 14, and unscrewing the lid as described hereinabove.

After the flushing of the adhesive material is completed, the operator releases the button 50 or the foot pedal 54, so that the solenoid 42 and the pinch valve 40 will automatically close, and the purge valve 62 can be returned to the closed position by manipulating the knob 63 for closing the air line 60.

From the foregoing, it will be observed that numerous variations and modifications may be effected without departing from the true spirit and scope of the novel concept of the invention. It is to be understood that no limitation with respect to the specific apparatus illustrated and described herein is intended or should be inferred. It is, of course, intended to cover by the apended claims all such modifications as fall within the scope of the claims.

What is claimed is:

1. A self-cleaning apparatus for dispensing adhesive materials from a sealed container of adhesive through a flexible conduit, and for purging said conduit of adhesive material when said container is replaced or refilled, comprising:

means for providing compressed air under pressure, first and second air lines each having one end secured to said compressed air means, pressure regulator means communicating with the opposite end of said first air line, a normally closed solenoid valve means communicating with the opposite end of said second air line, said container having a lid defining first and second openings, dip tube means extending downwardly from said second opening, a third air line having one end in communication with said pressure regulator means and an opposite end secured to said first opening in said lid for providing pressurized air to said container, said flexible conduit having one end secured to said second opening for receiving adhesive from said container, means for dispensing said adhesive, said dispensing means having an open end, said flexible conduit having an opposite end secured to said adhesive dispensing means, first valve means for opening and closing said flexible conduit, a fourth air line extending between and communicating with said solenoid valve means and said first valve means, means for actuating said solenoid valve means for providing pressurized air to travel through said solenoid and said fourth air line to said first valve means, a fifth air line having one end communicating with said second air line between said compressed air means and said solenoid valve means, nozzle means secured to the opposite end of said fifth air line, said nozzle means being adapted to provide an air tight connection with said open end of said dispensing means, second valve means for opening and closing said fifth air line, whereby said dispensing means, said flexible conduit and said dip tube means may be purged of said adhesive when desired by connecting said open end of said dispensing means to said nozzle means, closing said pressure regulator means, and opening said first and second valve means, whereupon said compressed air travels from said means for providing compressed air, through said second air line, said fifth air line, said nozzle means, said dispensing means, said flexible conduit, said dip tube means, and into said container, thereby flushing said adhesive into said container from said dispensing means, said flexible conduit and said dip tube means.

2. A self-cleaning apparatus as set forth in claim 1 wherein said container further includes a third opening having a pressure relief valve.

3. A self-cleaning apparatus as set forth in claim 1 wherein said first valve means comprises a pneumatically operated pinch valve.

4. A self-cleaning apparatus as set forth in claim 1 wherein said means for actuating said solenoid valve means comprises pedal means that is adapted to be engaged by the operator of the apparatus, and wherein an electric wire extends from said pedal means to said solenoid means.

5. A self-cleaning apparatus as set forth in claim 1 wherein said means for actuating said solenoid valve means comprises switch means positioned on said dispensing means, said switch means being adapted to be engaged by the operator of the apparatus, and wherein an electric wire extends from said switch means to said solenoid means.

* * * * *